US008530719B1

(12) United States Patent
Peterson et al.

(10) Patent No.: US 8,530,719 B1
(45) Date of Patent: Sep. 10, 2013

(54) ZIRCONIUM HYDROXIDE FOR DECONTAMINATING TOXIC AGENTS

(75) Inventors: Gregory W. Peterson, Belcamp, MD (US); Joseph A. Rossin, Columbus, OH (US); George W. Wagner, Elkton, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 452 days.

(21) Appl. No.: 12/917,811

(22) Filed: Nov. 2, 2010

(51) Int. Cl.
*A62D 3/33* (2007.01)

(52) U.S. Cl.
USPC ..... 588/401; 588/315; 588/408

(58) Field of Classification Search
USPC ..... 588/315, 313, 401, 402, 405, 408, 588/409, 901
See application file for complete search history.

(56) References Cited

U.S. PATENT DOCUMENTS 5,645,518 A * 7/1997 Wagh et al. ..... 588/318
5,990,373 A * 11/1999 Klabunde ..... 588/313

* cited by examiner

*Primary Examiner* — Edward Johnson
(74) *Attorney, Agent, or Firm* — Ulysses John Biffoni

(57) ABSTRACT

The present invention relates to a process for decontaminating surfaces contaminated with toxic agents. The process comprises contacting a contaminated surface with a sorbent comprised of zirconium hydroxide onto which at least one reactive moiety is optionally impregnated.

19 Claims, No Drawings

ZIRCONIUM HYDROXIDE FOR DECONTAMINATING TOXIC AGENTS

U.S. GOVERNMENT INTEREST

The invention described herein may be manufactured, used and licensed by or for the U.S. Government.

FIELD OF INVENTION

This invention relates to sorbents and methods of making and using the same for decontaminating surfaces contaminated with highly toxic agents, including chemical warfare ("CW") agents and/or industrial chemicals, insecticides, and the like.

BACKGROUND OF THE INVENTION

Exposure to toxic agents, such as CW agents and related toxins, is a potential hazard to the armed forces and to civilian populations, since CW agents are stockpiled by several nations, and other nations and groups actively seek to acquire these materials. Some commonly known CW agents are bis-(2-chloroethyl)sulfide (HD or mustard gas), pinacolyl methylphosphonofluoridate (GD), Tabun (GA), Sarin (GB), cyclosarin (GF), and O-ethyl S-(2-diisopropylamino)ethyl methylphosphonothioate (VX), as well as analogs and derivatives of these agents, and any additional nerve or vesicant agents. These CW agents are generally delivered as fine aerosol mists which, aside from presenting an inhalation threat, will deposit on surfaces of military equipment and hardware, including uniforms, weapons, vehicles, vans and shelters. Once such equipment and hardware is contaminated with one of the previously mentioned highly toxic agents, the agent must be removed in order to minimize contact hazards.

For this reason, there is an acute need to develop and improve technology for decontaminating highly toxic materials. This is especially true for the class of toxic agents known as nerve agents, which are produced and stockpiled for both industrial use and as CW agents. One class of nerve agents with a high level of potential lethality is the class that includes organophosphorus-based ("OP") compounds, including, but not limited to, Sarin, Soman, and VX. Such agents can be absorbed through inhalation and/or through the skin of an animal or person. The organophosphorus-type ("OP") CW materials typically manifest their lethal effects against animals and people by inhibiting acetylcholine esterase ("AChE") enzyme at neuromuscular junctions between nerve endings and muscle tissue to produce an excessive buildup of the neurotransmitter acetylcholine, in an animal or person. This can result in paralysis and death in a short time.

In addition to the concerns about CW agents, there is also a growing need in the industry for decontaminating industrial chemicals and/or insecticides, for example, AChE-inhibiting pesticides such as parathion, paraoxon and malathion, among others. Thus, it is very important to be able to effectively detoxify a broad spectrum of toxic agents, including, but not limited to, organophosphorus-type compounds, from contaminated surfaces and sensitive equipment.

Furthermore, CW agents and related toxins are so hazardous that simulants have been developed for purposes of screening decontamination and control methods. HD simulants include 2-chloroethylethyl sulfide (CEES) and 2-chloroethylphenyl sulfide (CEPS). G-agent simulants include dimethyl methyl phosphonate (DMMP). VX simulants include O,S-diethyl phenylphosphonothioate (DEPPT).

Currently, the U.S. Army uses a nerve agent decontamination solution called DS2, which is composed (by weight) of 2% NaOH, 28% ethylene glycol monomethyl ether, and 70% diethylenetriamine (Richardson, G. A. "Development of a package decontamination system," EACR-1 310-17, U.S. Army Edgewood Arsenal Contract Report (1972), incorporated by reference herein). Although this decontamination solution is effective against OP nerve agents, it is quite toxic, flammable, highly corrosive, and releases toxic by-products into the environment. For example, a component of DS2, namely diethylenetriamine, is a teratogen, so that the manufacture and use of DS2 also presents a potential health risk. DS2 protocol calls for waiting 30 minutes after DS2 application, then rinsing the treated area with water in order to complete the decontamination operation. The use of water in the operation presents logistics burdens, as now large volumes of water must be transported and stockpiled at the decontamination site.

The U.S. Army also uses a decontamination material called XE555 resin (Ambergard™ Rohm & Haas Company, Philadelphia, Pa.), to remove toxic agents from the contaminated surface as rapidly as possible. However, XE555 has several disadvantages. Although effective at removing chemical agents, XE555 does not possesses sufficient reactive properties to neutralize the toxic agent(s) absorbed by this resin. Thus, after use for decontamination purposes, XE555 itself presents an ongoing threat from off-gassing toxins and/or vapors mixed with the resin. In addition, XE555 is relatively expensive in the quantities required for decontamination purposes.

Meanwhile, reactive sorbents have been developed and used to both absorb and react with highly toxic materials to yield less toxic products. One example is M100 sorbent decontamination system (SDS) for decontaminating highly toxic materials. The M100 SDS utilizes an alumina-based reactive sorbent called A-200-SiC-1005S, which is in the form of a powder. The reactive sorbent powder acts as an inexpensive, non-corrosive, non-harmful absorber designed to be rubbed onto a contaminated surface and does not require water rinse or special disposal. The reactive sorbent is structured to flow readily across a contaminated surface, and is highly porous, allowing it to absorb the highly toxic material quickly. The absorbed highly toxic material is strongly retained within the pores of the reactive sorbent, which reacts to form less toxic products, thereby minimizing off-gassing and contact hazards. Details of this sorbent are provided in U.S. Pat. No. 6,852,903.

Another example is U.S. Pat. No. 5,689,038, to Bartram and Wagner, disclosing the use of an aluminum oxide, or a mixture of aluminum oxide and magnesium monoperoxyphthalate (MMPP), as reactive sorbents to decontaminate surfaces contacted with droplets of chemical warfare agents. It has been reported that both materials were able to effectively remove such toxic agents from a surface to the same extent as XE555. In addition, both materials represented improvements in chemical warfare agent degrading reactivity and in reducing off-gassing of toxins relative to XE555. The reported sorbents were based on pre-existing, commercially available materials, such as Selexsorb CD™, a product of the Alcoa Company. Essentially, Bartram and Wagner reported that their aluminum oxide is modified by size reduction, grinding or milling.

Another example is U.S. Pat. No. 6,537,382 to Bartram and Wagner, disclosing the use of two types of reactive sorbents. One comprises metal exchanged zeolites such as silver-exchanged zeolite, and the other comprises sodium zeolites. The reactive sorbents remove, and then decompose chemical agents from the surface being decontaminated. Similar in all reactive sorbents, this dual action provides the advantage of reducing the risks associated with potential off-gassing from the sorbent, and reducing the toxicity of the sorbent for disposal purposes.

However, inasmuch as the above-mentioned solid-phase decontaminants are able to quickly remove CWAs from surfaces, they suffer from slow reactions with the adsorbed agents. Once contaminated, these sorbents present a persistent hazard themselves following their use. The hazard is particularly acute for VX, the most persistent and toxic of these agents, where half-lives ranging from several hours to several days (and even months) are not uncommon.

Recently, two notable improvements on absorbing and removing VX have been reported. The first by Wagner, Wu, and Kleinhammers (U.S. patent application Ser. No. 11/668,524 "Nanotubular Titania for Decontamination of Chemical Warfare Agents"; and Wagner, G. W.; Chen, Q.; Wu, Y. "Reactions of VX, GD, and HD with Nanotubular Titania J. Phys. Chem. C 2008, 112, 11901-11906) discloses that VX reacts rapidly with nanotubular titania (NTT). This material affords VX half-lives on the order of several minutes (Wagner, G. W. unpublished results). A second titania material, nanocrystalline titania ($nTiO_2$), exhibits an even faster VX reactivity, allowing half-lives less than 2 minutes (Wagner, G. W. "Decontamination Efficacy of Candidate Nanocrystalline Sorbents with Comparison to SDS A-200 Sorbent: Reactivity and Chemical Agent Resistant Coating Panel Testing" ECBC-TR-724, in press; unclassified report).

Still, there remains a need in the art for even more rapid and effective sorbents for decontaminating toxic agents, and the methods for rapidly and effectively removing and/or decontaminating toxic agents in an environmentally acceptable and cost-effective process.

SUMMARY OF THE INVENTION

This invention relates to novel processes for decontaminating surfaces contaminated with toxic agents using sorbents. The sorbent is comprised of zirconium hydroxide ($Zr(OH)_4$), wherein the sorbent is found to be effective and rapid in decontaminating toxic agents.

DETAILED DESCRIPTION OF THE INVENTION

The present invention relates to a sorbent which has been found useful in processes for removing and subsequently detoxifying toxic materials from surfaces. The sorbent is comprised of zirconium hydroxide ($Zr(OH)_4$), wherein upon contact with the toxic materials, the half lives of the toxic materials are rapidly and greatly reduced.

Accordingly, the invention provides novel methods for removing and detoxifying a wide range of highly toxic materials, including CW agents. In order to appreciate the scope of the invention, the terms "toxin," "toxic agent," and "toxic material," are intended to be equivalent, unless expressly stated to the contrary. In addition, the terms, "nerve gas," "nerve agent," "vesicant", "neurotoxic," and the like are intended to be equivalent, and to refer to a toxin that acts or manifests toxicity, at least in part, by disabling a component of an animal nervous system, e.g., AchE inhibitors.

In addition, the use of a term in the singular is intended to encompass its plural in the appropriate context, unless otherwise stated. In addition, reference herein to toxic agents are intended to encompass CW agents, including, e.g., bis-(2-chloroethyl)sulfide (HD or mustard gas), pinacolyl methylphosphonofluoridate (GD), Tabun (GA), Sarin (GB), cyclosarin (GF), and O-ethyl S-(2-diisopropylamino)ethyl methylphosphonothioate (VX), other toxic organophosphorus-type agents, their analogs or derivatives, and similar such art-known toxins. In addition, unless otherwise stated, the term toxic agent as used herein is also intended to include toxic industrial chemicals, including, but not limited to, organophosphorus-type insecticides, and the like.

Broadly, the novel methods provided by the invention are directed to the use of modified sorbents effective for removing, and then deactivating or neutralizing, toxic agents. The term "sorbents" according to the invention includes any composition that is capable of absorbing, adsorbing, or otherwise taking up harmful toxic materials including toxic agents, and then catalytically or stoichiometrically reacting, converting, deactivating, neutralizing, or detoxifying at least a portion of the absorbed toxic agent. The term "surfaces" applies to hard surfaces such as counter tops, concrete, metals, plastic, tiles, and so forth, soft surfaces such as fabric, film, leather, carpet or upholstery, or that of human or animal skin surfaces.

Sorbents

Zirconium hydroxide ($Zr(OH)_4$), or hydrous zirconia is used as a sorbent in the present invention. Zirconium hydroxide is an amorphous, white powder that is insoluble in water. The structure of zirconium hydroxide, $Zr(OH)_4$, may be represented as a two-dimensional square lattice, each connected by a double hydroxyl bridge yielding a stoichiometric $Zr(OH)_4$. $Zr(OH)_4$ particles contain both terminal and bridging hydroxyl groups. Although we refer to the substrate as zirconium hydroxide, the product may be in the form of a polymorph of zirconium hydroxide, zirconium oxyhydroxide and zirconium oxide. The $Zr(OH)_4$ may be in amorphous state, crystalline solid, or mixture thereof.

The sorbent preferably exhibits an average particle size of from about 5 nm to 5 μm. If not commercially available in these ranges, the sorbents can be readily rendered into these ranges by pulverization, milling, and the like. The sorbent further exhibits a surface area in the range of from about 20 to 1000 $m^2/g$, and more preferably from about 300 to 600 $m^2/g$. The sorbent exhibits a pore volume in the range of from about 0.1 to 1.0 $cm^3/g$, and more preferably from about 0.4 to 0.7 $cm^3/g$.

The sorbent is in the form of unagglomerated or agglomerated powder, agglomerated particles, granules, or compacted sheet. As granules, the sorbent has a particle size of about 0.1 mm to about 4 mm. The sorbent can also be formulated into aerosol, paste, foams, slurry, or patch, gel, or cream. The sorbent can further be incorporated into coatings, paints, fabrics, suits, and garments.

Optional Materials

At least one reactive and/or catalytic moiety/functional group is/are optionally incorporated onto the sorbent. Suitable reactive moieties are selected from base metals. The suitable base metals include vanadium, chromium, manganese, iron, cobalt, nickel, copper, zinc, silver, molybdenum, and mixtures thereof. Copper, zinc, and silver are preferred. The base metal is present in the amount of about 5% to about 40% by weight of the sorbent. An amount of about 15% to about 25% is also useful.

The suitable reactive moieties are also selected from amines. The suitable amines are triethylamine (TEA), quinuclidine (QUIN), triethylenediamine (TEDA), pyridine, and pyridine carboxylic acids such as pyridine-4-carboxylic acid (P4CA). Triethylenediamine is most preferred. The loading of TEDA can be as low as 0 wt. %, or as high as about 6 wt. %. A preferred amount of TEDA used is of from about 3% to about 6% by weight of the sorbent.

The optional reactive moieties can be used sequentially, in combination, or as a combined mixture with porous zirconium hydroxide.

The porous zirconium hydroxide is also optionally filled uniformly or saturated with a sufficient amount of an organic solvent, while maintaining the modified sorbents in a dry, free-flowing powder form. The organic solvent occupying the pores of the sorbents can be in a liquid or solid phase.

The selection of the organic solvent can be made from any organic solvent capable of dissolving all highly toxic materials, including chemical warfare agents and remaining non-reactive with the sorbent while exhibiting sufficiently low volatility to remain on the sorbent during the decontamination phase. In a more preferred embodiment of the present invention, the organic solvent is an alkane having a chemical formula $C_nH_{2n+2}$, wherein n is at least 9, and preferably, at least 20, and combinations thereof. In a most preferred embodiment of the present invention, the organic solvent is selected from mineral oil, paraffin wax, and combinations thereof.

The amount of organic solvent present to sufficiently saturate the pores of the sorbent, while maintaining the sorbent in a dry, free-flowing powder form, ranges from about 5% to 50% by weight, preferably 15% to 35% by weight, and more preferably 20% to 30% by weight based on the total weight of the modified sorbent. Alternatively, the amount of the organic solvent is present in a sorbent to solvent weight proportion of about 10 parts sorbent to a range of from about 1 to 5 parts solvent, and more preferably of from about 2 to 3 parts solvent. Further information regarding sorbents impregnated by organic solvents can be found in U.S. Pat. No. 7,678,736, which is hereby incorporated by reference.

Other optional materials are, but not limited to, fragrance, surfactants, dispersants, antiseptics, soil release polymer, color-indicating materials, color speckles, colored beads, dyes, sealants, and mixtures thereof.

Method for Preparing the Sorbents

Zirconium hydroxide may be prepared by precipitating zirconium salts, such as for example zirconium oxynitrate and zirconium oxychloride, in aqueous solutions using alkaline solutions to bring about precipitation. Examples of alkaline solutions include ammonium hydroxide, potassium hydroxide and sodium hydroxide. Alternatively, zirconium hydroxide may be purchased from a commercial source such as Magnesium Elektron Inc. or MEL Chemicals of Flemington, N.J. The substrate may be in the form of a polymorph of zirconium hydroxide, zirconium oxyhydroxide and zirconium oxide.

Porous zirconium hydroxide impregnated with reactive moieties may be prepared using techniques well known to one skilled in the art. The powder (in agglomerated or non-agglomerated form) is then impregnated using ammonium solutions containing the target concentration of base metal(s) and, if desired, alkali metals. Following impregnation, the material is then dried at temperatures not to exceed about for example 200° C., and preferably not to exceed about for example 100° C., as this will bring about the dehydration of the zirconium hydroxide, reducing its porosity and also, its sorbent effectiveness.

Following drying, the impregnated material, if desired, can then be forwarded for amine, such as for example TEDA, impregnation. TEDA impregnation may be performed using techniques known to one skilled in the art. Preferably, TEDA is impregnated via a sublimation operation. For example, a known mass of the impregnated powder plus the desired amount of TEDA are loaded into a V-blender or rotating drum, for example, for the purpose of contacting the formed powder with TEDA. During the operation, TEDA will sublime into the pores of the powder over time. Heating the apparatus to temperatures on the order of about 50° C. to 100° C., for example, will speed the sublimation operation.

The TEDA containing impregnated powder is then formed into the desired geometric form, e.g. particles, beads, extrudates, etc., of the desired size using techniques known to those skilled in the art. One method is to form the powder into pills or tablets using a tableting machine. Alternatively, the powder can be pressed into large tablets, which are then crushed and sieved into particles of the desired mesh size.

A more preferred method of preparation involves impregnation of the porous $Zr(OH)_4$ in the form of a powder. This is accomplished using impregnation techniques as described above. For example, the $Zr(OH)_4$ powder is preferably dried at for example 100° C. to remove pre-adsorbed moisture. An impregnation solution is prepared by dissolving a base metal salt, e.g. carbonate in a concentrated ammonium solution. The powder is then contacted with the solution until incipient wetness is achieved. At this point, the powder is dried in an oven at for example 100° C. Once dry, the powder can be impregnated with TEDA by placing the desired amount of powder and the desired amount of TEDA in a device designed to contact the two materials, such as for example a V-blender or rotating drum. The TEDA and impregnated powder are blended for a time sufficient to allow the TEDA to sublime into the pores. The TEDA containing impregnated powder is then formed into the desired geometric form, e.g. particles, beads, extrudates, etc., of the desired size using techniques known to those skilled in the art. One method is to form the powder into pills or tablets using a tableting machine. Alternatively, the powder can be pressed into large tablets, which are then crushed and sieved into particles of the desired mesh size.

An even more preferred method of preparation involves precipitation of the metals onto the porous $Zr(OH)_4$ substrate. For example, $Zr(OH)_4$ powder is slurried in water. To the slurry is added a predetermined amount of alkali metal hydroxide, such as for example, sodium hydroxide, potassium hydroxide or lithium hydroxide. A second solution is prepared containing a base metal salt dissolved in DI water, for example zinc sulfate, zinc nitrate, zinc chloride, zinc acetate, copper sulfate, copper nitrate, copper chloride, silver nitrate, silver chloride, silver acetate, silver sulfate etc. Mixtures of salts may also be employed. The solution is then added to the slurry. The pH of the slurry is then adjusted to the target value, of between about 5 and about 13, preferably between about 7 and about 11, more preferably between about 9 and about 10. The pH adjuster is an appropriate acid, such as for example sulfuric acid, nitric acid, hydrochloric acid or formic acid. The reduction in pH will result in the base metal being precipitated onto the surface of the zirconium hydroxide substrate, likely in the form of a metal hydroxide, such as zinc hydroxide, copper hydroxide, etc. Upon completion of the precipitation, the slurry is filtered, then washed with DI water to remove any residual acid. The resulting solids are dried. The resulting dried powder may then be impregnated with TEDA as described previously. Upon completion of the TEDA impregnation operation, the resulting powder may be formed into particles as described previously using techniques known to one skilled in the art, or simply kept as a powder.

An advantage of the above mentioned precipitation procedure is that the use of ammonia can be readily avoided, so ammonia off-gassing from the sorbent will not occur.

Porous zirconium hydroxide impregnated with organic solvents may be prepared using techniques well known to one skilled in the art. Preferably the sorbent is suitably dried to remove any moisture from the surface and the pores to less than 0.5% water. The sorbent may be suitably dried by simple heating in air, inert atmosphere, or under vacuum, for example. Depending on the scale, the mixing vessel can be selected from a rotary evaporator, cone blender, ribbon mixer, "V" blender, and the like, or any device or technique suitable for contacting liquids and solids, and the actual amounts can vary in proportion to the desired scale of manufacture. Thus, each 100 g of sorbent is mixed with from about 80 to about 120 g of organic solvent, depending on the porosity of the employed sorbent. For organic solvents that are solid at room temperature (e.g., paraffin wax), the organic solvent must be melted down to a liquid phase for impregnating the sorbent. Once in the vessel, the organic solvent in liquid phase is contacted with the sorbent under an inert atmosphere (e.g., dry $N_2$) until insipient wetness is achieved. Alternatively, the sorbent can be contacted with the organic solvent by spraying, dripping and the like.

Once the impregnation step is complete, at least a portion of the excess organic solvent is evaporated. In particular, the excess organic solvent is evaporated from the sorbent such that the resulting sorbent has from about 10% to about 100% of the pore volume filled with the organic solvent, and preferably from about 50 to about 90% of the pore volume filled.

Process for Decontaminating Surfaces Using the Sorbents

In carrying out the process of the invention, the sorbent is placed in direct contact with the contaminated surface that is intended to be detoxified or rendered free of toxic agents.

The decontamination operation can take place over a wide range of temperatures and humidity values consistent with ambient conditions. For example, the contacting step can be carried out at a temperature of from about −40° C. to about 200° C., preferably about −40° C. to about 45° C. The relative humidity can be as low as less than 10% to greater than 90%.

It is preferred that the sorbent be allowed to contact the contaminated surfaces for at least about 0.5 minutes, preferably from about 1-100 minutes, and more preferably from about 1.5-20 minutes.

The methods of the present invention for decontaminating surfaces can be carried out by spraying, rubbing, brushing, dipping, dusting, or otherwise contacting the sorbents of the invention with a surface or composition that is believed to be in need of such treatment. Upon contact, the toxic agents are detoxified within the pores of the sorbent, after their half-lives have been reduced to an acceptable level.

In one embodiment of the invention, the reactive sorbent is dispersed as a suspension in a suitable carrier. Suitable carriers include polar and nonpolar solvents, e.g., water-based or organic solvent based carriers. Preferably, the carrier is prepared with sufficient viscosity to allow the composition to remain on treated articles or surfaces, for a sufficient time period to remove contaminants.

In a preferred embodiment of the invention, the sorbent is applied as a dry powder or dust onto contaminated articles or surfaces.

The sorbent powder can be poured onto the surface. Preferably, the sorbent powder is rubbed across the surface via a manual or mechanical action, resulting in good contact between droplets of at least one toxic agent (located on the surface) and the sorbent powder. "Good contact" is defined herein as at least 80% surface to surface contact between two objects with a minimal obstruction. Methods for facilitating contacting between at least one toxic agent (located on the surface) and the sorbent may simply include rubbing with a wash mitt, brush, or cloth applicator.

In another preferred embodiment, the granulated form is optionally formulated so as to remain cohesive, while absorbing a liquid suspected of containing toxic agents. Advantageously, the used sorbent in granulate form is readily scooped or shoveled off the treated surface for further processing or disposal.

The artisan will appreciate that selection of the form in which the inventive composition is dispersed will depend upon the physical form of the contaminant(s), the nature of the terrain and/or equipment or personal needing decontamination, and the practical needs of distribution and removal of the used or spent sorbent.

For purposes of the present invention, it will be understood by those of ordinary skill in the art that the term "sufficient", as used in conjunction with the terms "amount", "time" and "conditions" represents a quantitative value that provides a satisfactory and desired result, i.e., detoxifying toxic agents or decontaminating surfaces, which have been in contact with toxic agents. The amounts, conditions and time required to achieve the desired result will, of course, vary somewhat based upon the amount of toxic agent present and the area to be treated. For purposes of illustration, the amount of sorbent required for decontaminating a surface is generally, at minimum, an amount that is sufficient to cover the affected area surface. The time required for achieving a satisfactory detoxification or neutralization of toxic agents is in the range of about less than 30 seconds to about 3 hours.

One of ordinary skills in the art would appreciate that the present invention can be use by military personnel, police officers, firefighters, or other first responders in government, civil, private, or commercial settings.

Example 1

Half-Lives for VX, GD and HD on the Sorbents

A quadruplicate of 5 μL liquid samples were prepared from VX, GD, and HD. A triplicate of each of four different sorbents, in the amount of 200 mg, was produced using the above-disclosed method. The four different sorbents were zirconium hydroxide ($Zr(OH)_4$), porous zirconium hydroxide combined with ZnO, porous zirconium hydroxide combined with TEDA, and porous zirconium hydroxide combined with a mixture of ZnO and TEDA. Each of the prepared liquid samples of the toxic agents was applied onto the prepared sorbents. The disappearance of toxic agent in the sorbent was monitored using either 31P MAS NMR (for VX, GD) or 13C MAS NMR (for HD), and the amount of agent at discrete time intervals were measured to plot a curve from which the half-live was determined:

| Agent | $Zr(OH)_4$ | $Zr(OH)_4$/ZnO/TEDA | $Zr(OH)_4$/ZnO | $Zr(OH)_4$/TEDA |
|---|---|---|---|---|
| VX | <30 seconds | 20 minutes to 6 hours | 15 min to 1.3 hours | 1.2 hours |
| GD | 8.7 minutes | 2.2 minutes | N/A | N/A |
| HD | 2.3 hours | 3 to 6 hours | N/A | N/A |

It can be shown from the data that VX reacts the fastest with un-modified $Zr(OH)_4$, while the modified $Zr(OH)_4$ has a much longer detoxification time. For GD, the modification of $Zr(OH)_4$ leads to enhanced reactivity. Similarly to VX, HD reacts the fastest with the un-modified $Zr(OH)_4$.

Therefore, $Zr(OH)_4$ exhibits unprecedentedly-fast detoxification of adsorbed VX, outperforming even $nTiO_2$ in this regard. Moreover, the material possesses innate reactivity towards GD as well, and the reactivity is further enhanced by a modification of $Zr(OH)_4$ with ZnO and/or TEDA. Although considerably slower, $Zr(OH)_4$ also affords reactivity for HD.

The invention claimed is:

1. A process for decontaminating surfaces contaminated with at least one toxic agent, wherein said at least one toxic agent is an organophosphorus-based ("OP") compound, and wherein said organophosphorus-based compound is a chemical warfare agent selected from pinacolyl methylphosphonofluoridate (GD), Tabun (GA), Sarin (GB), cyclosarin (GF), O-ethyl S-(2-diisopropylamino)ethyl methylphosphonothioate (VX), and analogs and derivatives thereof, or an insecticide selected from parathion, paraoxon, and malathion, said process comprising applying onto said contaminated surfaces a sorbent comprised of zirconium hydroxide.

2. The process of claim 1, wherein said sorbent contains at least one reactive moiety selected from base metals, organic solvents, and amines.

3. The process of claim 2, wherein said base metals are vanadium, chromium, manganese, iron, cobalt, nickel, copper, zinc, silver, molybdenum, or mixtures thereof.

4. The process of claim 3, wherein, said base metal is zinc, copper, or silver.

5. The process of claim 4, wherein said base metal is present in the amount of about 5% to about 40% by weight of said sorbent.

6. The process of claim 2, wherein said amines are triethylamine (TEA), quinuclidine (QUIN), triethylenediamine (TEDA), pyridine, or pyridine-4-carboxylic acid (P4CA).

7. The process of claim 6, wherein said amine is triethylenediamine (TEDA).

8. The process of claim 2, wherein said organic solvent is an alkane having a chemical formula $C_nH_{2n+2}$, wherein n is at least 9.

9. The process of claim 8, wherein said organic solvent is selected from mineral oil, paraffin wax, and combinations thereof.

10. The process of claim 9, wherein said organic solvent is present in an amount of about 5% to 50% by weight of said sorbent.

11. The process of claim 1, wherein said sorbent is applied in the form of powder, granules, agglomerated particles, or compacted sheets.

12. The process of claim 1, wherein said sorbent is applied onto surfaces in the form of aerosol, paste, foam, slurry, patch, gel or cream.

13. The process of claim 1, wherein said sorbent is dispersed as a suspension in a carrier selected from polar and nonpolar solvents.

14. The process of claim 1, wherein said zirconium hydroxide has a particle size of from about 5 nm to about 5 μm.

15. The process of claim 11, wherein the granules of said sorbent has a particle size of about 0.1 mm to about 4 mm.

16. The process of claim 1, wherein said sorbent is applied by spraying, rubbing, brushing, dipping, or dusting said sorbents with surfaces contaminated with at least one said toxic agent.

17. The process of claim 16, wherein said sorbent is rubbed across said surfaces via a manual or mechanical action.

18. The process of claim 16, wherein said toxic agents are immobilized to said sorbent, and said sorbent is removed after the half-lives of said at least one toxic agents have been reduced to an acceptable level.

19. The process of claim 1, wherein said at least one toxic agent comprises bis-(2-chloroethyl)sulfide (HD or mustard gas).

* * * * *